US009188890B1

(12) United States Patent
Winters

(10) Patent No.: US 9,188,890 B1
(45) Date of Patent: Nov. 17, 2015

(54) METHOD FOR MANAGING TRIBOELECTRIC CHARGE IN TWO-COMPONENT DEVELOPER

(71) Applicant: XEROX CORPORATION, Norwalk, CT (US)

(72) Inventor: James A. Winters, Alfred Station, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/489,427

(22) Filed: Sep. 17, 2014

(51) Int. Cl.
*G03G 15/08* (2006.01)
*G03G 9/08* (2006.01)

(52) U.S. Cl.
CPC ..... *G03G 9/0815* (2013.01); *G03G 15/0822* (2013.01)

(58) Field of Classification Search
CPC ..... G03G 15/0822–15/0829
USPC ..... 399/253, 254, 259
See application file for complete search history.

(56) References Cited

U.S. PATENT DOCUMENTS 3,847,604 A 11/1974 Hagenbach et al.
4,935,326 A 6/1990 Creatura et al.
4,937,166 A 6/1990 Creatura et al.
5,236,629 A 8/1993 Mahabadi et al.
5,278,020 A 1/1994 Grushkin et al.
5,290,654 A 3/1994 Sacripante et al.
5,302,486 A 4/1994 Patel et al.
5,308,734 A 5/1994 Sacripante et al.
5,330,874 A 7/1994 Mahabadi et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,659,860 A * 8/1997 Sasaki et al. ..... 399/267
5,722,008 A * 2/1998 Laing ..... 399/54
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.

(Continued)

*Primary Examiner* — David Gray
*Assistant Examiner* — Sevan A Aydin
(74) *Attorney, Agent, or Firm* — Pillsbury Winthrop Shaw Pittman LLP

(57) ABSTRACT

Disclosed is a method for managing the triboelectric charge potential of a two-component xerographic developer over a wide range of variables. In particular, the present embodiments uses the addition of second and third carrier particles to a developer comprising toner particles and first carrier particles to adjust the tribo electric charge potential of the developer. Various parameters (system responses), including $V_{mag}$, laser power, relative humidity, toner and carrier age, and image scan data, are used to determine the requisite amounts of the second and third carrier to achieve a desired shift in tribo electric charge potential of the developer.

20 Claims, 4 Drawing Sheets

(56) References Cited

U.S. PATENT DOCUMENTS

| | | | |
|---|---|---|---|
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |
| 5,925,488 | A | 7/1999 | Patel et al. |
| 5,928,829 | A | 7/1999 | Cheng et al. |
| 5,977,210 | A | 11/1999 | Patel et al. |
| 5,994,020 | A | 11/1999 | Patel et al. |
| 6,576,389 | B2 | 6/2003 | Vanbesien et al. |
| 6,617,092 | B1 | 9/2003 | Patel et al. |
| 6,627,373 | B1 | 9/2003 | Patel et al. |
| 6,638,677 | B2 | 10/2003 | Patel et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,673,505 | B2 | 1/2004 | Jiang et al. |
| 6,730,450 | B1 | 5/2004 | Moffat et al. |
| 6,743,559 | B2 | 6/2004 | Combes et al. |
| 6,756,176 | B2 | 6/2004 | Stegamat et al. |
| 6,780,500 | B2 | 8/2004 | Dumouchel |
| 6,830,860 | B2 | 12/2004 | Sacripante et al. |
| 7,029,817 | B2 | 4/2006 | Robinson et al. |
| 7,455,943 | B2 | 11/2008 | Patel et al. |
| 7,700,252 | B2 | 4/2010 | Silence et al. |
| 7,906,264 | B2 | 3/2011 | Takahashi et al. |
| 7,910,275 | B2 | 3/2011 | Patel et al. |
| 8,062,822 | B2 | 11/2011 | Inoue et al. |
| 8,142,971 | B2 | 3/2012 | Mizutani et al. |
| 8,227,163 | B2 | 7/2012 | Veregin et al. |
| 8,293,445 | B2 | 10/2012 | Tsurumi et al. |
| 2007/0014591 | A1* | 1/2007 | Amano et al. ..... 399/254 |
| 2010/0158572 | A1* | 6/2010 | Knapp ..... 399/254 |
| 2010/0190101 | A1* | 7/2010 | Shimmura ..... 430/111.41 |

* cited by examiner

METHOD FOR MANAGING TRIBOELECTRIC CHARGE IN TWO-COMPONENT DEVELOPER

BACKGROUND

Disclosed herein is a method for managing the triboelectric charge of a two-component xerographic developer over a wide range of variables.

Because of the large number of variables surrounding xerographic printers, such as environmental conditions, job stresses, material variabilities, and the like, it is difficult to engineer a xerographic material with respect to tribo electric properties that remains optimum through all variables. As a result, xerographic latitude suffers.

The development health of a xerographic system is directly related to cases in which the triboelectric charge of the system is too high or too low. These instances happen because tribo charging is very much dependent on environmental conditions such as the grains of moisture in the air, the printing job such as low area versus high area coverage printing, and even carrier and toner manufacturing variations. When these variables are in play, xerographic printing can suffer from latitude constraints which limit where the printer can operate and the jobs the printer can print. Even with the limitations, the print quality often degrades as well.

Current methods of managing tribo electric charge within a machine generally entail manipulating the toner concentration (TC) by adding toner. There are, however, limitations. Too low of a TC can lead to supply constraints and too much TC can lead to saturated carrier and poor charging toner.

A method for managing developer health that enables printing performance over a wide range of uncontrolled variables, such as relative humidity, temperature, developer age, print job types, printer consumables variations and the like. Such a method can, in some embodiments, enable the ability to vary different settings on the printer under a wide variety of conditions, enabling greater system latitude. It can also provide opportunities to remove expensive environmental control units for temperature and humidity. Further, the ability to adjust tribo electric charge can allow for mitigation of difficulties such as pollution of the development wires in hybrid scavengeless development (HSD) type development systems, high $V_{mag}$, image line variation, image background defects, random clusters of toner particles known as "spits" that are transferred from the photoconductive belt to the copy sheet, light solid image areas, loose toner contamination within the printer, and the like.

SUMMARY

Disclosed herein is a method for controlling the triboelectric charge potential of a developer in a developer housing comprising:

(a) providing a developer comprising toner particles and first carrier particles;

(b) using the developer to develop electrostatic latent images;

(c) determining a desired triboelectric charge potential of the developer (d) subsequent to step (b), determining the actual triboelectric charge of the developer; and (e) subsequent to step (d), adding to the developer a mixture of second carrier particles and third carrier particles, the triboelectric charge on the second carrier particles being different from that on the third carrier particles, in amounts sufficient to adjust the actual triboelectric charge of the developer to a value closer to the desired triboelectric charge potential of the developer. Where the charge potential is defined as the propensity of carrier component of the developer to impart charge on the toner component. In embodiments, the desired triboelectric charge potential of the developer determined in step (c) is from about 70 μC/g to 80 μC/g, or from about 40 μC/g to 50 μC/g, or from about 20 μC/g to 25 μC/g.

Also disclosed herein is a method for controlling the triboelectric charge potential of a developer in a developer housing comprising:

(a) providing a developer comprising toner particles and first carrier particles;

(b) using the developer to develop electrostatic latent images;

(c) determining a desired triboelectric charge potential of the developer (d) subsequent to step (b), determining the actual triboelectric charge potential of the developer;

(e) subsequent to step (d), adding to the developer a mixture of second carrier particles and third carrier particles, the triboelectric charge on the second carrier particles being different from that on the third carrier particles, in amounts sufficient to adjust the actual triboelectric charge potential of the developer to a value closer to the desired triboelectric charge potential of the developer;

(f) subsequent to step (e), further determining the actual triboelectric charge of the developer; and (g) repeating steps (d) through (f) until the desired triboelectric charge potential of the developer is achieved.

In other embodiments, there is disclosed an imaging apparatus comprising:

(a) a photoconductive belt;

(b) a charging station situated to generate an electrostatic charge on the photoconductive belt;

(c) an exposure station situated to generate an electrostatic latent image on the charged photoconductive belt;

(d) a development station situated to develop the electrostatic latent image on the charged photoconductive belt, said development station comprising:

(1) a developer housing situated to contain a two-component developer for developing the electrostatic latent image;

(2) a replenishment system situated to supply toner particles and carrier particles to the developer housing, said replenishment system comprising:

(A) a developer sump operatively connected to the developer housing and containing toner particles and first carrier particles;

(B) a toner sump operatively connected to the developer sump and containing toner particles;

(C) a first carrier sump operatively connected to the developer sump and containing second carrier particles;

(D) a second carrier sump operatively connected to the developer sump and containing third carrier particles; and (E) a controller operatively connected to the developer sump, the toner sump, the second carrier sump, and the third carrier sump, said controller controlling the relative amounts of second carrier particles and third particles dispensed into the developer sump by:

(i) determining a desired triboelectric charge potential of the developer in the developer sump;

(ii) using the developer in the developer sump to develop electrostatic latent images;

(iii) subsequent to step (i), determining the actual triboelectric charge of the developer in the developer sump;

(iv) subsequent to step (ii), determining the actual triboelectric charge of the developer in the developer sump;

(v) subsequent to step (iv), adding to the developer in the developer sump a mixture of second carrier particles and third carrier particles, wherein the second carrier particles are only fed from the first carrier sump and the third carrier particles are only fed from the second carrier sump and further wherein the triboelectric charge on the second carrier particles being different from that on the third carrier particles, in relative amounts sufficient to adjust the actual triboelectric charge of the developer in the developer sump to a value closer to the desired triboelectric charge potential of the developer; and (vi) subsequent to step (v), determining the actual triboelectric charge of the developer in the developer sump;

(e) a transfer station situated to transfer the developed image from the photoconductive belt to a sheet; and (f) a fuser assembly situated to affix permanently the transferred image to the sheet.

DETAILED DESCRIPTION

Figure 1:
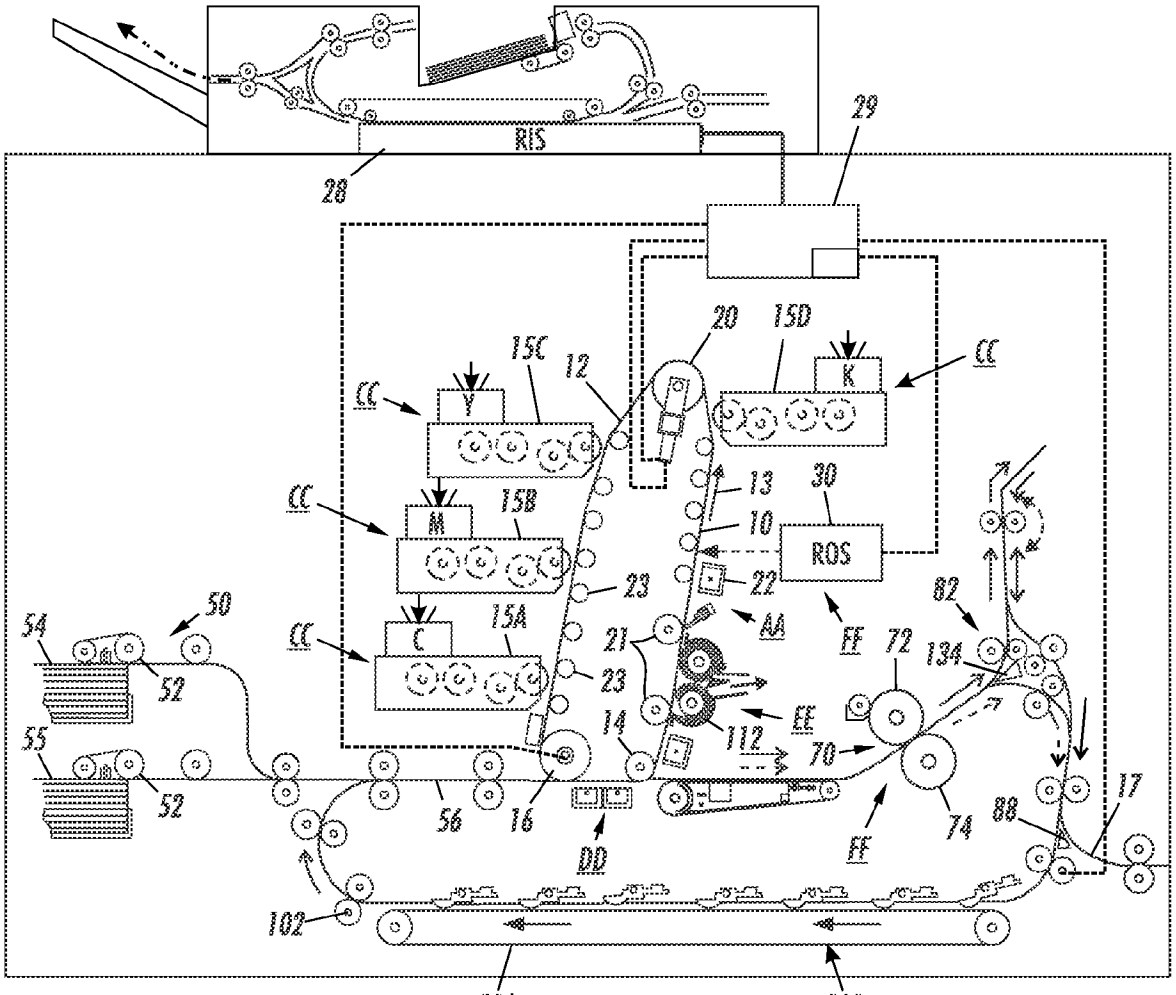
FIG. 1 illustrates schematically an electrostatographic reproduction machine employing the development replenishment system disclosed herein.

As a xerographic developer is used, the toner is consumed for the development of images. During development, some carrier also escapes the developer. The existing carrier particles also get damaged over the life of the developer. Accordingly, replenisher developer has some carrier particles mixed in with the toner particles. The replenishment process entails trickling out old developer and trickling in new developer or carrier. During this process, there is no way to control which carrier (old versus new) is trickled out.

The process disclosed herein comprises the use of a mixture of at least two different carriers in the replenishment process. The second carrier is selected to have a low triboelectric charge with respect to the selected toner, and the third carrier is selected to have a high triboelectric charge with respect to the selected toner. The triboelectric charge (tribo) of the replenished developer is controlled by varying the ratio of the two carriers taking into account selected variables.

Any desired or effective toner can be employed, including positively charging or negatively charging toners. Examples of suitable toners include those disclosed in U.S. Pat. Nos. 7,906,264, 7,910,275, 7,700,252, 7,455,943, 5,853,943, 5,922,501, 5,928,829, 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,747,215, 5,763,133, 5,766,818, 5,804,349, 5,827,633, 5,840,462, 5,853,944, 5,863,698, 5,869,215, 5,902,710; 5,910,387; 5,916,725; 5,919,595; 5,925,488, 5,977,210, 5,994,020, 6,576,389, 6,617,092, 6,627,373, 6,638,677, 6,656,657, 6,656,658, 6,664,017, 6,673,505, 6,730,450, 6,743,559, 6,756,176, 6,780,500, 6,830,860, and 7,029,817, the disclosures of each of which are totally incorporated herein by reference.

Any desired or effective carriers can be employed, including positively charging or negatively charging carriers. The most desired carrier to be used with this type of tribo electric control are carriers in which are designed to have a tribo electric control knob. An example of this control knob may be a particular surface treatment such as polymer coating, and the like. By having a tribo electric control knob, it becomes simple to build two or more carriers having different levels of tribo electric potentials. Examples of suitable carriers include those disclosed in U.S. Pat. Nos. 3,847,604, 4,937,166, 4,935,326, 5,236,629, 5,330,874, 8,293,445, 8,227,163, 8,142,971, and 8,062,822, the disclosures of each of which are totally incorporated herein by reference. One specific example of a suitable carrier design would be a carrier comprised of a ferrite core which has been coated with a blend of poly(methyl methacrylate) PMMA and Kynar resinr. The PMMA verses Kynar proportion as well as the coating thickness are the control knobs used to modify the tribo electric charge of this carrier design. Carrier 1 would have a PMMA/Kynar proportion which would yield a low tribo electric charge and Carrier 2 would have a PMMA/Kynar proportion which would yield a high tribo.

The toner particles and carrier particles are present with respect to each other in any desired or effective relative amounts, in one embodiment the ratio of toner:carrier by weight being at least about 1:100, and in another embodiment at least about 3:100, and in one embodiment no more than about 30:100, and in another embodiment no more than about 20:100. It is possible, however, that as toner particle sizes get smaller, greater than 30 pph would become more typical.

The second carrier particles and third carrier particles can differ by any desired or effective relative amount of triboelectric charge, in one embodiment at least about microcoulombs per gram (15 μC/g), in another embodiment at least about 70 μC/g.

Illustrated in the Figures is one exemplary embodiment of the method disclosed herein, illustrating an imaging method using four different-colored developers. Other embodiments, such as single-color development processes and other methods for generating and developing electrostatic latent images, can also be employed.

FIG. 1 schematically illustrates an electrostatographic reproduction machine 8 employing a photoconductive belt 10 mounted on a belt support module within a machine frame 11. The photoconductive belt 10 is made from a photoconductive material coated on a conductive grounding layer that is coated on an anti-curl backing layer. Belt 10 moves in the direction of arrow 13 to advance successive portions sequentially through various processing stations disposed about the path of movement thereof. Belt 10 is entrained as a closed loop about stripping roll 14, drive roll 16, idler roll 21, and backer rolls 23.

Initially, a portion of the photoconductive belt surface passes through charging station AA, where a charging wire of a corona-generating device indicated by reference numeral 22 charges photoconductive belt 10 to a relatively high, substantially uniform potential.

Reproduction machine 8 also includes a controller or electronic control subsystem (ESS) 29 that is a self-contained, dedicated minicomputer having a central processor unit (CPU), electronic storage, and a display or user interface (UI). The ESS 29, with the help of sensors and connections, can read, capture, prepare, and process image data and machine component status information to be used for controlling operation of each such machine component.

At an exposure station BB, ESS 29, receives image signals from a raster input scanner (RIS) 28 representing a desired output image and processes these signals to convert them to a continuous tone or gray scale rendition of the image that is transmitted to a modulated output generator, for example the raster output scanner (ROS), indicated by reference numeral 30. The image signals transmitted to ESS 29 may originate from RIS 28 as described above or from a computer, thereby enabling the electrostatographic reproduction machine 8 to serve equally as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. At exposure station BB, ROS 30 illuminates the portion on the surface of photoconductive belt 10 at a resolution of about 300 or more pixels per inch. The ROS exposes the photoconductive belt 10 to record an electrostatic latent image thereon corresponding to the image received from ESS 29. As an alternative, ROS 30 may employ a linear array of light emitting diodes (LEDs) arranged to illuminate the portion of photoconductive belt 10 on a raster-by-raster basis.

After the electrostatic latent image has been recorded on photoconductive surface 12, belt 10 advances the latent image through development station CC that includes four two-component developer housings 15A, 15B, 15C, 15D, each containing in-use (being used) two-component developer material comprising carrier particles and CMYK color toner particles, one color per developer housing. At each developer housing 15A, 15B, 15C, 15D the toner particles contained in the developer material that is in-use are appropriately attracted electrostatically to and develop the latent image.

In-use developer material (that is, the mix of carrier and toner particles) in each developer housing becomes depleted of toner particles over time as toner particles develop more and more images. Fresh toner particles hence have to be frequently and controllably added to the developer housing. Another cause of poor image quality has been found to be aging carrier.

After the electrostatic latent image is developed, the toner powder image present on belt 10 advances to transfer station DD. A print sheet 48 is advanced to the transfer station DD by sheet feeding apparatus 50, which may include a corrugated vacuum feeder (TCVF) assembly 52 for contacting the uppermost sheet of stack 54, 55. TCVF 52 acquires each top copy sheet 48 and advances it to sheet transport 56. Sheet transport 56 directs the advancing sheet 48 into image transfer station DD to receive a toner image from photoreceptor belt 10 in a timed manner. Transfer station DD includes a corona-generating device 58 that sprays ions onto the backside of copy sheet 48, which assists in attracting the toner powder image from photoconductive surface 12 to sheet 48. After transfer, sheet 48 continues to move in the direction of arrow 60, where it is picked up by a pre-fuser transport assembly 101 and forwarded by means of a vacuum transport 110 to a fusing station FF that includes a fuser assembly 70.

Fuser assembly 70 includes a heated fuser roller 72 and a pressure roller 74 with the powder image on the copy sheet contacting fuser roller 72. The pressure roller is pressed against the fuser roller to provide the necessary pressure to fix the toner powder image to the copy sheet. Fuser roller 72 is internally heated by a quartz lamp (not shown).

Sheet 48 then passes through fuser assembly 70 where the image is permanently fixed or fused to the sheet. After passing through fuser 70, a gate 88 either allows the sheet to move directly via output 17 to a finisher or stacker, or deflects the sheet into duplex path 101. Specifically, the sheet (when being directed into duplex path 101) is first passed through a gate 134 into a single sheet inverter 82. If the second sheet is either a simplex sheet, or a completed duplexed sheet having both side one and side two images formed thereon, the sheet will be conveyed via gate 88 directly to output 17. If the sheet is being duplexed and is then only printed with a side one image, the gate 88 will be positioned to deflect that sheet into inverter 82 and into duplex loop path 101, where that sheet will be inverted and then fed to acceleration nip 102 and belt transports 110 for recirculation back through transfer station DD and fuser 70 for receiving and permanently fixing the side two image to the backside of that duplex sheet before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 112 at cleaning station EE.

After passing through the fusing apparatus 70, gate 88 either allows the sheet to move directly via output 17 to a finisher or stacker (not shown), or deflects the sheet into duplex path 101. Specifically, the sheet (when being directed into the duplex path 101) is first passed through gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into inverter 82 and into duplex loop path 101, where that sheet will be inverted and then fed for recirculation back through the toner image forming module for receiving an unfused toner image on side two thereof.

Development station CC of electrostatographic image reproduction machine 8 with two-component developer housings 15A, 15B, 15C, 15D includes replenishment developer systems 200A, 200B, 200C, and 200D adding fresh developer to each of two-component developer housings 15A, 15B, 15C, 15D, respectively. Development replenishment systems in general are known, as disclosed in, for example, U.S. Pat. No. 8,050,595, the disclosure of which is totally incorporated herein by reference.

Figure 2:
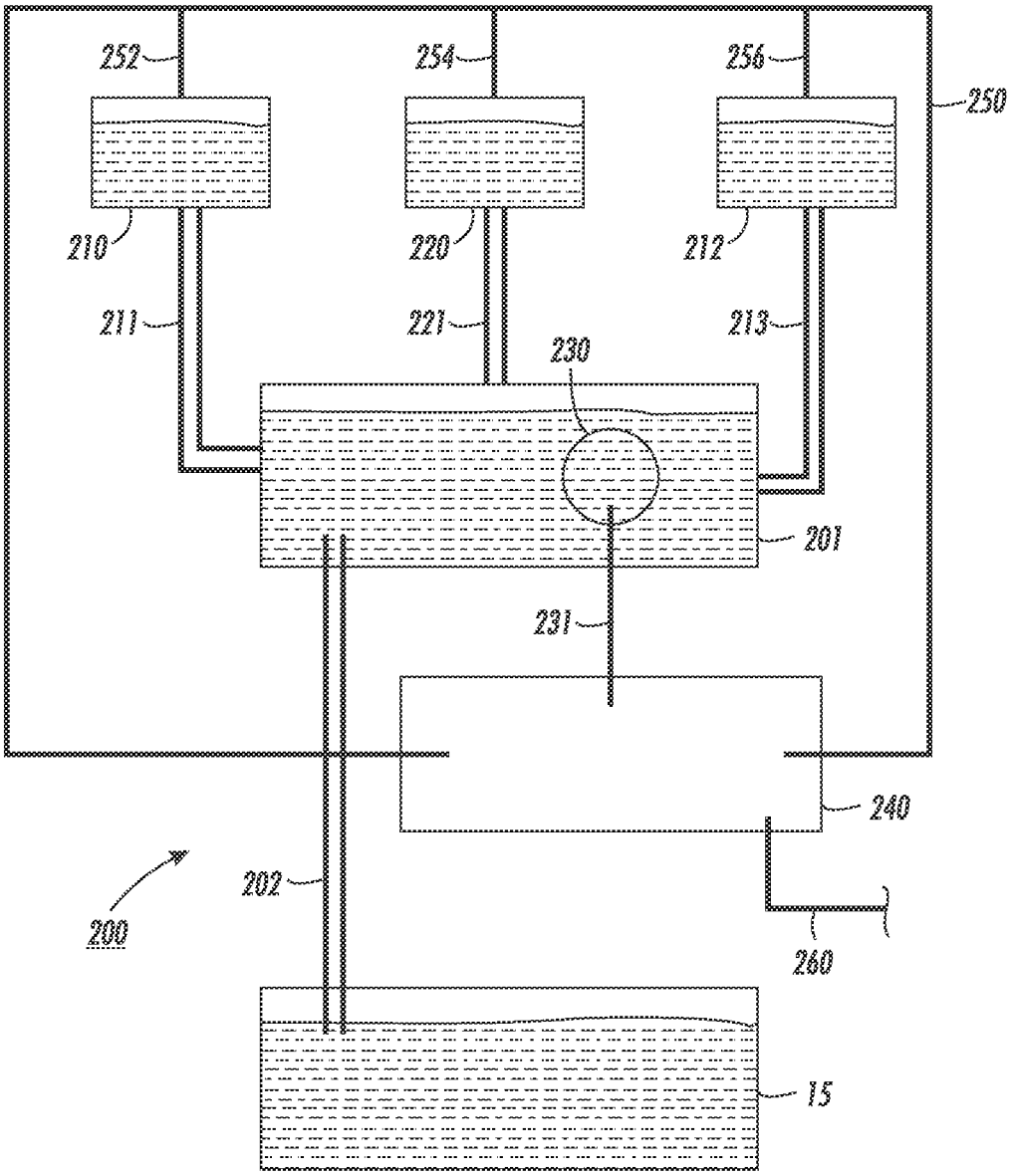
FIG. 2 illustrates schematically a development replenishment system as disclosed herein.

Illustrated schematically in FIG. 2 is a representative two-component developer housing 15 fed by replenishment system 200. Replenishment system 200 includes developer sump 201 operatively connected to housing 15 by means such as a hose or tubing 202. Developer sump 201 in turn is fed by toner sump 220, operatively connected to developer sump 201 by means as a hose or tubing 221, first carrier sump 210, operatively connected to developer sump 201 by means such as a hose or tubing 211, and second carrier sump 212, operatively connected to developer sump 201 by means such as a hose or tubing 213. The toner concentration TC is determined in developer sump 201 by sensor 230, electrically connected to controller 240 by connector 231. Methods for determining TC are known, as disclosed in, for example, U.S. Pat. Nos.

8,145,078 and 5,839,022, the disclosure of which is totally incorporated herein by reference. Controller 240 is part of circuit 250, to which the first carrier sump 210 is connected by connector 252, toner sump 220 is connected by connector 254, and second carrier sump 212 is connected by connector 256. In specific embodiments, the first carrier sump 210 contains the high tribo carrier and the second carrier sump 212 contains the low tribo carrier.

Figure 3:
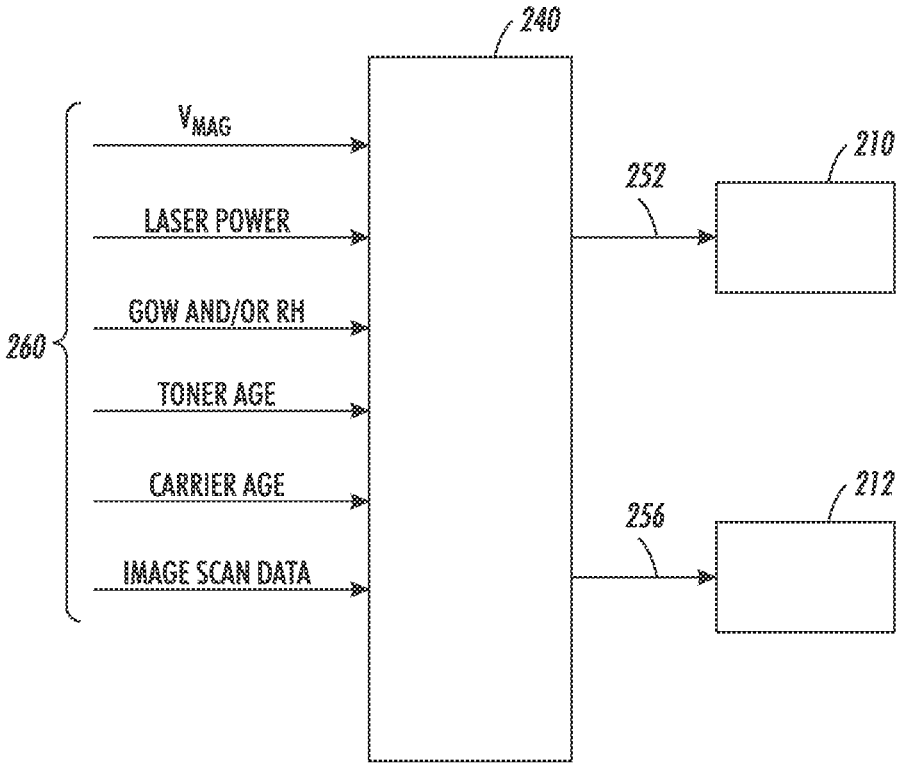
FIG. 3 illustrates schematically various types of input that can be made into the controller of the development replenishment system disclosed herein.

Further input of information into controller 240, discussed in FIG. 3, is via input 260.

In one embodiment, as illustrated schematically in FIG. 3, since measurement of tribo electric charge of the toner directly in the developer sump can be difficult, additional input 260 into controller 240 can, if desired, include one or more of parameters to be discussed in the following paragraphs.

$V_{mag}$, or magnetic roll bias, is a measurement of the bias on the magnetic brush. The "magnetic brush" comprises a magnetic roller in the development housing and the developer particles. This magnetic brush has a bias measured in volts. The development potential or $V_{em}$, or difference between the bias of the magnetic brush and the bias of the photoconductive belt image, is the image development field, which controls how much toner jumps from the magnetic brush to the undeveloped latent image, and in turn controls image darkness or lightness.

High tribo electric charge toners caused by high tribo stress conditions need a high development field to achieve the correct developed toner mass whereas low tribo electric charge toners caused by low tribo stress conditions need low development field to achieve the correct developed toner mass. While it is typical for a modern printer to control the magnetic brush to maintain mass control; often times due to the wide variety of external stress (noises), the printer is unable to compensate enough by adjusting the magnetic brush bias. There may be instances that the extremes in the development potential will cause other defects and have to be avoided. During these conditions, a reduction or increase of the tribo electric charge of the toner is desired to compensate for the lack of adjustment in development potential and other machine actuators.

Figure 4:
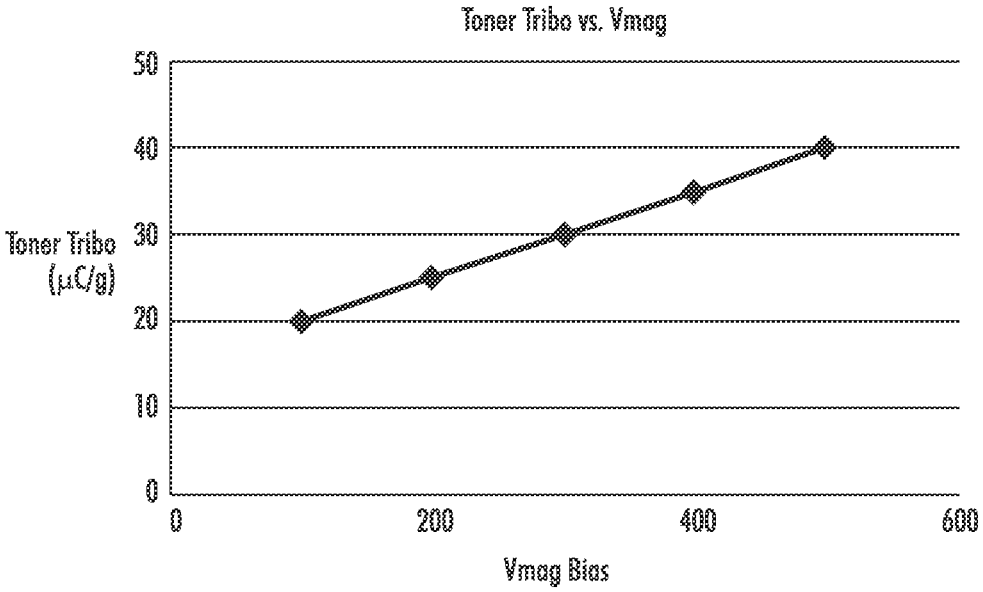
FIG. 4 illustrates the relationship between $V_{mag}$ and tribo electric charge of toner.

As shown in FIG. 4, it is shown that $V_{mag}$ is directly related to tribo electric charge. More specifically, higher $V_{mag}$ is caused by higher tribo electric charge of the toner materials as indicated in the graph. $V_{mag}$ is shown as a direct linear relationship to tribo electric charge, however, in actuality; the relationship can be any type of relationship. In this specific example, $V_{mag}$ becomes a surrogate measurement of material tribo electric charge. Because $V_{mag}$ is easily measured within the printer and has specific limitations to its adjustment range, as $V_{mag}$ approaches an upper or lower limit, the tribo electric charge can be actuated by increasing the dispense of the higher or lower tribo carrier material. Typically the limits of the power supply define the limits of Vmag bias. The power supply must be sufficient to create a large enough development potential to create an image with sufficient density. This may be dependent on the tribo operating space of the printer and the hardware architecture. $V_{mag}$ can be measured with a closed loop control approach in which the $V_{mag}$ is measured as a feedback to a carrier dispense rate controller. In the latter case, a desired $V_{mag}$ would be the setpoint to the closed loop controller. The control equation for this controller may be any variant of traditional P, PI, PID control equations. In some cases more advance techniques may be implements for anti-windup and actuator saturation. Other implementation may use look up tables for setting the carrier rate based on experimentation during product design.

Laser power is used for generating the electrostatic latent images on the photoconductive belt. The power required to obtain images of the desired quality may need to be adjusted over the life of the developer. This information can provide input into controller 240 and allow for adjustment either by the controller or the user or both.

Relative humidity (RH), is a measurement that accounts for temperature, or grains of water (GOW) in the atmosphere, a similar measurement which does not take into account temperature. The amount of moisture in the atmosphere affects tribo electric charge. Sensors detecting RH and/or GOW can provide input into controller 240 and allow for adjustment either by the controller or the user or both.

Toner age is a determination of the amount of time the toner particles have resided in the developer housing, a calculation based on the in and out streams. Some toners lose tribo electric charge and some toners gain tribo electric charge with age. The results of this calculation can provide input into controller 240 and allow for adjustment either by the controller or the user or both.

Carrier age is a determination of the amount of time the carrier particles have resided in the developer housing, a calculation based on the in and out streams. Some carriers lose tribo electric charge and some carriers gain tribo electric charge with age. The results of this calculation can provide input into controller 240 and allow for adjustment either by the controller or the user or both.

Input from one or more image scanner sensors that scan an image (such as a full width array image) either while it is on the photoconductive belt prior to transfer, or after transfer to the copy sheet, may also be used by the controller 240 to allow for adjustment either by the controller or the user or both. The sensor measures image quality in terms of banding, mottle, density, nonuniformity, line patterns, and/or any similar image defects and correlates them to known relationship to tribo electric charge for the particular developer.

Based on the various parameters used and their relationship to tribo electric charge of the toner, the controller 240 determines the relative concentrations of second carrier and third carrier that are delivered to developer sump 201 from first carrier sump 210 and second carrier sump 212 to achieve the final tribo electric charge of the developer that is desired.

In another embodiment (not illustrated), tribo electric charge in developer sump 201 is measured directly by methods such as those illustrated in U.S. Pat. No. 7,912,386 the disclosure of which is totally incorporated herein by reference. Controller 240 then determines the relative concentrations of second carrier and third carrier that are delivered to developer sump 201 from first carrier sump 210 and second carrier sump 212 to achieve the desired tribo electric charge of the developer.

The response time of the system to adjustments in carrier concentration may not be immediate. Small systems take less time to respond than large systems, with typical periods of time being from about 1 to about 5 hours between the adjustment and observation of a change in tribo electric charge of the developer.

The relative ratio of second carrier to third carrier can be anywhere from 100:0 to 0:100, depending on the desired tribo electric charge of the developer, and is in one specific embodiment from about 99:1 to about 1:99 depending on the desired tribo level. In a specific embodiment, the ratio would is 50:50 when the printer is centered in its desired operating space. A 50:50 mixture allows for sufficient tribo adjustment capability in both the upward direction and the downward direction.

The high tribo carrier and the low tribo carrier must meet the needs of the development system. Some examples of these tuning properties may be density, magnetic properties, conductivity, particle size, etc. The high and low tribo carrier must meet these properties and must be compatible when mixed together. Compatibility is defined as no interactions with the exception of additive tribo levels. One way to accomplish this is to have the high tribo carrier and low tribo carrier be identical with the exception of a tribo modifier such as coating recipe and/or weight percent.

In specific embodiments, the addition of the second and/or third carrier to the developer brings the tribo electric charge potential of the developer as close as possible to the desired value, in one specific embodiment within about 30 μC/g, in another embodiment within about 15 μC/g, and in yet another embodiment within about 3 μC/g of the desired value. In alternative embodiments, the addition of the second and/or third carrier to the developer is based on the $V_{mag}$ measured in the printer. In such examples, the addition of the second and/or third carrier is used to obtain a $V_{mag}$ in a range of from about 350V to about 450, or in other embodiments of from about 150 to about 250, or in yet other embodiments of from about 50 to about 100.

In embodiments, the desired range of the tribo electric charge potential of the developer is from about 75 μC/g to about 150 μC/g, or in another embodiment, from about 25 μC/g to about 50 μC/g, and in yet another embodiment from about 10 μC/g to about 30 μC/g.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A method for controlling the triboelectric charge potential of a developer in a developer housing comprising:

(a) providing a developer comprising toner particles and first carrier particles;

(b) using the developer to develop electrostatic latent images;

(c) determining a desired triboelectric charge potential of the developer (d) subsequent to step (b), determining the actual triboelectric charge of the developer; and (e) subsequent to step (d), adding to the developer a mixture of second carrier particles and third carrier particles, wherein the second carrier particles are fed from a first carrier sump and the third carrier particles are fed from a second carrier SUMP and further wherein the triboelectric charge on the second carrier particles being different from that on the third carrier particles, in amounts sufficient to adjust the actual triboelectric charge potential of the developer to a value closer to the desired triboelectric charge potential of the developer.

2. The method of claim 1, wherein an actual triboelectric charge of the developer's charge potential is further determined subsequent to step (e).

3. The method of claim 2, wherein the actual triboelectric charge is within 3 μC/g of the desired triboelectric charge potential of the developer determined in step (c).

4. The method of claim 1, wherein the desired triboelectric charge potential of the developer determined in step (c) is from 70 μC/g to 80 μC/g.

5. The method of claim 1, wherein the actual triboelectric charge potential of the developer in step (d) is determined with a sensor.

6. The method of claim 1, wherein step (e) is performed with a sensor that inputs the actual triboelectric charge value into a controller which calculates the ratio of second carrier particles to third carrier particles to achieve the desired triboelectric charge potential of the developer.

7. The method of claim 1, wherein the mixture of second carrier particles and third carrier particles in step (e) is determined by a controller which calculates the ratio of second carrier particles to third carrier particles based at least in part on the value of $V_{mag}$.

8. The method of claim 7, wherein the mixture of second carrier particles and third carrier particles are determined to obtain a $V_{mag}$ in a range of from 150 Volts to 250 Volts.

9. The method of claim 1, wherein the mixture of second carrier particles and third carrier particles in step (e) is determined by a controller which calculates the ratio of second carrier particles to third carrier particles based at least in part on laser power used for generating electrostatic latent images.

10. The method of claim 1, wherein the mixture of second carrier particles and third carrier particles in step (e) is determined by a controller which calculates the ratio of second carrier particles to third carrier particles based at least in part on Relative humidity (RH) or grains of water (GOW).

11. The method of claim 1, wherein the mixture of second carrier particles and third carrier particles in step (e) is determined by a controller which calculates the ratio of second carrier particles to third carrier particles based at least in part on toner age.

12. The method of claim 1, wherein the mixture of second carrier particles and third carrier particles in step (e) is determined by a controller which calculates the ratio of second carrier particles to third carrier particles based at least in part on carrier age.

13. The method of claim 1, wherein the mixture of second carrier particles and third carrier particles in step (e) is determined by a controller which calculates the ratio of second carrier particles to third carrier particles based at least in part on image scan data.

14. The method of claim 1, wherein a ratio of the second carrier particles to the third carrier particles is from about 99:1 to about 1:99.

15. The method of claim 1, wherein the second carrier particles and third carrier particles differ in tribo electric charge potential with respect to a toner by at least about 15 microcoulombs per gram.

16. The method of claim 1, wherein a triboelectric charge potential with respect to a toner of the second carrier particles is from about 5 μC/g to about 200 μC/g.

17. The method of claim 1, wherein a triboelectric charge potential with respect to a toner of the third carrier particles is from about 5 μC/g to about 200 μC/g.

18. A method for controlling the triboelectric charge potential of a developer in a developer housing comprising:

(a) providing a developer comprising toner particles and first carrier particles;

(b) using the developer to develop electrostatic latent images;

(c) determining a desired triboelectric charge potential of the developer (d) subsequent to step (b), determining the actual triboelectric charge potential of the developer;

(e) subsequent to step (d), adding to the developer a mixture of second carrier particles and third carrier particles, wherein the second carrier particles are fed from a first carrier sump and the third carrier particles are fed from a second carrier sump and further wherein the triboelectric charge on the second carrier particles being different from that on the third carrier particles, in amounts sufficient to adjust the actual triboelectric charge potential of the developer to a value closer to the desired triboelectric charge potential of the developer;

(f) subsequent to step (e), further determining the actual triboelectric charge of the developer; and (g) repeating steps (d) through (f) until the desired triboelectric charge potential of the developer is achieved.

19. The method of claim 18, wherein a ratio of the second carrier particles to the third carrier particles is determined by a controller.

20. An imaging apparatus comprising:

(a) a photoconductive belt;

(b) a charging station situated to generate an electrostatic charge on the photoconductive belt;

(c) an exposure station situated to generate an electrostatic latent image on the charged photoconductive belt;

(d) a development station situated to develop the electrostatic latent image on the charged photoconductive belt, said development station comprising:

(1) a developer housing situated to contain a two-component developer for developing the electrostatic latent image;

(2) a replenishment system situated to supply toner particles and carrier particles to the developer housing, said replenishment system comprising:

(A) a developer sump operatively connected to the developer housing and containing toner particles and first carrier particles;

(B) a toner sump operatively connected to the developer sump and containing toner particles;

(C) first carrier sump operatively connected to the developer sump and containing second carrier particles;

(D) a second carrier sump operatively connected to the developer sump and containing third carrier particles; and (E) a controller operatively connected to the developer sump, the toner sump, the second carrier sump, and the third carrier sump, said controller controlling the relative amounts of second carrier particles and third particles dispensed into the developer sump by:

(i) determining a desired triboelectric charge potential of the developer in the developer sump;

(ii) using the developer in the developer sump to develop electrostatic latent images;

(iii) subsequent to step (i), determining the actual triboelectric charge of the developer in the developer sump;

(iv) subsequent to step (ii), determining the actual triboelectric charge of the developer in the developer sump;

(v) subsequent to step (iv), adding to the developer in the developer sump a mixture of second carrier particles and third carrier particles, wherein the second carrier particles are only fed from the first carrier sump and the third carrier particles are only fed from the second carrier sump and further wherein the triboelectric charge on the second carrier particles being different from that on the third carrier particles, in relative amounts sufficient to adjust the actual triboelectric charge of the developer in the developer sump to a value closer to the desired triboelectric charge potential of the developer; and (vi) subsequent to step (v), determining the actual triboelectric charge of the developer in the developer sump;

(e) a transfer station situated to transfer the developed image from the photoconductive belt to a sheet; and (f) a fuser assembly situated to affix permanently the transferred image to the sheet.

* * * * *